US006890054B2

(12) United States Patent
West

(10) Patent No.: US 6,890,054 B2
(45) Date of Patent: May 10, 2005

(54) AUTOMATIC STARTUP FOR A SOLVENT INK PRINTING SYSTEM

(75) Inventor: Kenneth J. West, Dayton, OH (US)

(73) Assignee: Eastman Kodak Company, Rochester, NY (US)

( * ) Notice: Subject to any disclaimer, the term of this patent is extended or adjusted under 35 U.S.C. 154(b) by 16 days.

(21) Appl. No.: 10/335,725

(22) Filed: Jan. 2, 2003

(65) Prior Publication Data

US 2004/0130605 A1 Jul. 8, 2004

(51) Int. Cl.[7] ..... B41J 2/165
(52) U.S. Cl. ..... 347/28
(58) Field of Search ..... 347/28, 20–22, 347/35, 84, 85, 86, 87, 89, 90, 95, 60

(56) References Cited

U.S. PATENT DOCUMENTS 6,742,876 B2 * 6/2004 Enz ..... 347/75
2002/0036670 A1 3/2002 Colombat et al.

FOREIGN PATENT DOCUMENTS

| | | |
|---|---|---|
| EP | 0424008 | 4/1991 |
| EP | 1013437 | 6/2000 |
| WO | WO 9806583 | 2/1998 |

* cited by examiner

*Primary Examiner*—Raquel Yvette Gordon
(74) *Attorney, Agent, or Firm*—Barbara Joan Haushalter

(57) ABSTRACT

An automatic start-up sequence is provided for an inkjet printer that uses volatile inks for printing. At startup, colorless flush fluid is employed to remove in the drop generator and from the exterior of the orifice plate and from the charge plate. Jets of the flush fluid are established. Stimulation is applied to the jets and charge voltage is applied to the associated charging electrodes to deflect the jets toward the catcher. Concurrent with the jets being so deflected, the jetting fluid is changed from flush fluid for cleaning to the ink for printing. The ability to control the jets of fluid with charge voltage prevents splattering of fluid on the charge leads during the transition from make-up fluid to ink.

22 Claims, 1 Drawing Sheet

SDP297PA

AUTOMATIC STARTUP FOR A SOLVENT INK PRINTING SYSTEM

TECHNICAL FIELD

The present invention relates to solvent ink printing systems and, more particularly, to an automatic startup process for a continuous ink jet printhead operating with solvent ink.

BACKGROUND ART

Ink jet printing systems are known in which a printhead defines one or more rows of orifices which receive an electrically conductive recording fluid from a pressurized fluid supply manifold and eject the fluid in rows of parallel streams. Printers using such printheads accomplish graphic reproduction by selectively charging and deflecting the drops in each of the streams and depositing at least some of the drops on a print receiving medium, while others of the drops strike a drop catcher device.

During the automatic startup sequence of a continuous ink jet printhead, the ink jets under pressure are stimulated to form uniform droplets that fall past the charge plate and catcher, but are caught in the sealing area of the eyelid seal and catch pan assembly and then are ingested into the catcher throat and returned to the fluid system by vacuum.

Over the years, a number of inkjet printers using binary array continuous inkjet printing have been developed, with continuing improvements in speed, reliability, and ease of use. These printers are used in a variety of print applications, often using aqueous inks. Using aqueous ink, these printers can print for hours and have demonstrated highly reliable automatic startups without operator intervention. In spite of advances in aqueous ink technology, solvent inks, such as ethanol or MEK based inks, are preferred for some applications. For example, in applications such as printing on metals or plastics, solvent inks are preferred over aqueous inks as a result of the solvent ink characteristics of being much faster drying and more permanent than aqueous inks.

The same characteristics that make solvent inks preferred for printing on metals and plastics, however, make solvent inks much harder to run in inkjet printers. Just as the inks dry quickly on the print media, they also dry quickly on the various components in an inkjet printhead and fluid system. In particular, these inks can dry quickly on the orifice plate and the charge plate in the printhead. On the orifice plate, the dried ink can plug the orifices through which the ink is to be jetted, adversely interfering with jet directionality. When dried on the charge plate, the dried ink can produce shorting conditions between charging electrodes.

Prior art system have proposed heating the ink to produce sufficient condensation of the ink solvent to rinse off the last of the ink residues from the charge plate. Unfortunately, heating the ink can cause other problems, including increased system cost. There continues to be a need for an automatic startup of an inkjet printer using highly volatile solvent based inks, which can be started up reliably without the need for operator intervention.

SUMMARY OF THE INVENTION

This need is met by the automatic startup according to the present invention, wherein the jets of ink are controlled with voltage applied at the charge leads. A particular feature of the present invention is to provide the automatic start-up without heating the ink. Eliminating the need to heat the ink provides a cost savings for the printing system because it allows for the removal of the condensation heater and for the temperature controller. The automatic startup of the present invention provides the additional safety advantage of not having to address a heater that comes in contact with flammable ink. Furthermore, the automatic startup provided by the present invention allows startup of the printing system to occur in less than 5 minutes, as compared to a typical startup time of 10 minutes for current systems.

In accordance with one aspect of the present invention, an automatic startup sequence is provided for an inkjet printer that uses volatile inks for printing. The startup sequence controls the jets of ink or make-up fluid by using voltage that is applied to the charge leads. The voltage deflects the jets of fluid toward the throat of the catcher where the fluid is taken back to the fluid system. This deflection of the jets of fluid keeps the fluid from traveling up the inner surface of the eyelid seal which can cause fluid to drip during the startup. The ability to control the jets of fluid with voltage during the startup also prevents splattering of fluid on the charge leads during the transition from make-up fluid to ink.

Other objects and advantages of the invention will be apparent from the following description, the accompanying drawings and the appended claims.

DETAILED DESCRIPTION OF THE PREFERRED EMBODIMENTS

Figure 1:
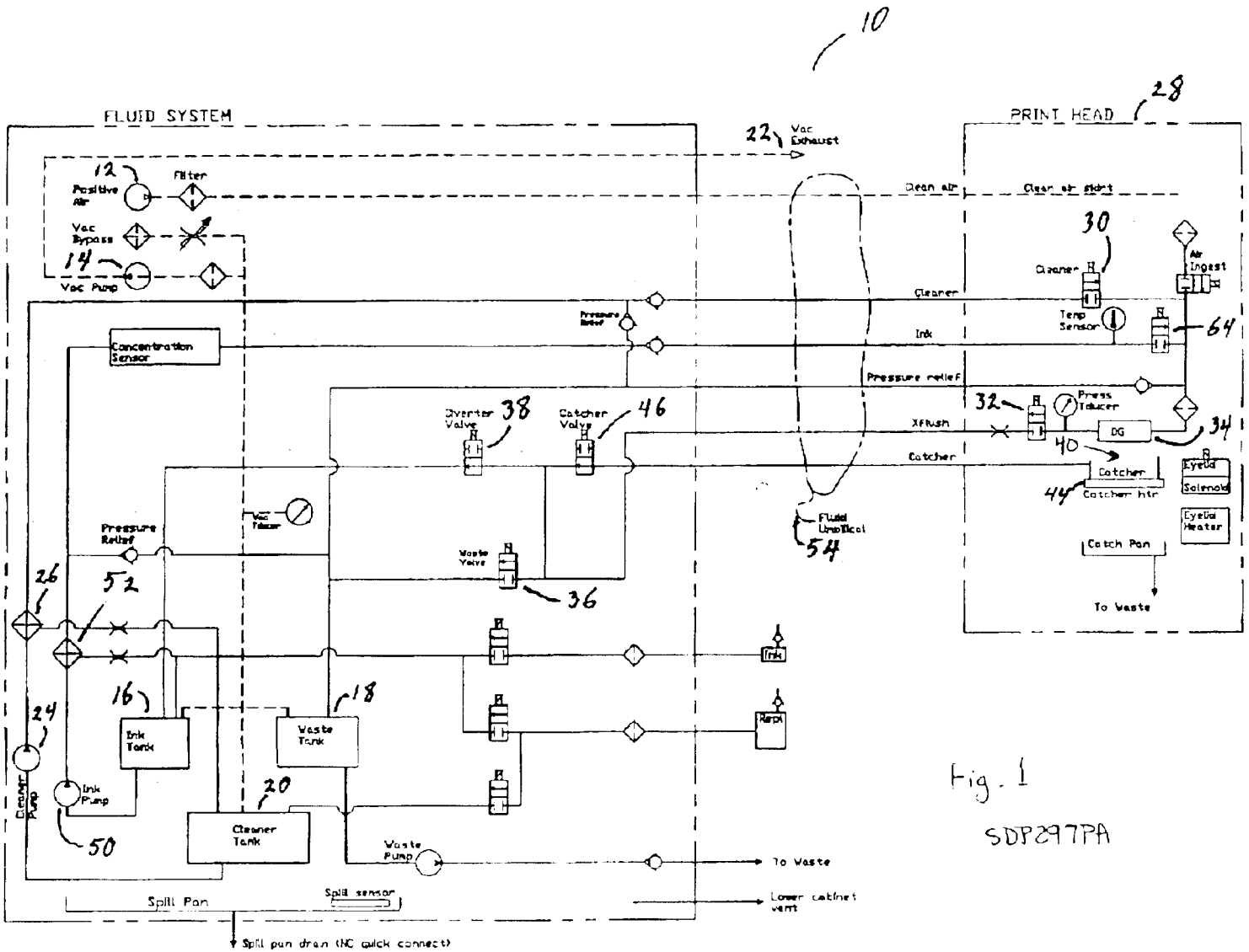
FIG. 1 is a block diagram illustration of a fluid system with which the automatic startup of according to the present invention can be applied.

The present invention proposes controlling the jets of fluid with the use of voltage, allowing the transition from make-up fluid to ink to occur without ink splattering on the charge leads. In accordance with the present invention, the automatic startup can be applied to a fluid system configured with one or more printheads. Since the separate inlets and outlets within each printhead interface controller (PIC) and printhead is identical, the following description will make reference only to a single printhead, without restricting the invention to use with a fluid system having only a single printhead.

Referring to FIG. 1, the automated startup sequence of the present invention is particularly suitable for startup of an inkjet printer using a solvent based ink. The automated startup sequence is described with reference to the fluid system schematic 10 that facilitates the startup. The startup sequence begins with turning on air pump 12. This provides a positive pressure in the printhead, reducing the concentration of flammable vapor in the printhead. A vacuum pump 14 is turned on to create a vacuum in the ink tank 16, waste tank 18, and the cleaner tank 20. The exhaust from the vacuum pump is directed to an exhaust port 22 on the exterior of the fluid system cabinet. This prevents a buildup of solvent vapors inside the fluid system cabinet. It also provides a convenient means to direct these vapors into fire-safe room exhaust means. Cleaner fluid pump 24 is turned on to pump flush fluid from the cleaner fluid tank 20 through filter means 26 and up to the printhead 28. Cleaner fluid valve 30 and crossflush valve 32 are open to allow the flush fluid to be pumped though the droplet generator 34 of the printhead. With waste valve 36 open and diverter valve 38 closed, flush fluid flows from the printhead to the waste tank 18, aided by the vacuum on the waste tank 18.

The flush fluid is then pumped to the printhead at a high enough flow rate to produce approximately 0.5 psi at the drop generator, with the crossflush valve 32 open. Pressurizing the drop generator 34 to this pressure causes flush fluid to weep out of the orifices of the droplet generator. This weeping crossflush serves to sweep dried ink and other particles out of the drop generator. It also redissolves any dried ink present in the orifices. The flush fluid weeping out of the orifices also begins rinsing off the exterior of the orifice plate 40, associated charge plate, and the catcher 44 face. This ink flows out of the catcher 44 to the waste tank 18 through the open catcher valve 46 and waste valve 36, as a result of the vacuum on the waste tank 18. The diverter valve 38 is closed to prevent the used flush fluid from flowing into the ink tank 16. In this way, the flush fluid does not affect the concentration of the ink in the ink reservoir 16. As described in co-pending, commonly assigned U.S. application Ser. No. 10/264,751, totally incorporated herein by reference, it is possible to employ the used flush fluid that is directed into the waste tank 18 as a replenishment fluid for the ink in the ink tank 16 to make up for evaporative losses.

This weeping crossflush state is followed by a state having lower flow rate through the drop generator 34. At this reduced flow rate, the vacuum on the waste tank 18 is sufficient to produce a slight vacuum at the drop generator 34. The vacuum at the droplet generator is at a level that is too high for the fluid to be able to exit through the orifices of the drop generator. Instead, the vacuum causes air to be ingested into the drop generator up through the orifices to remove any particles on the inside of the orifice plate.

These weeping crossflush and air ingest states are repeated with extremely high "super-stim" stimulation amplitudes applied to the drop generator. Super-stim, known in the art and as defined, for example, in U.S. Pat. No. 4,600,928, involves applying an AC voltage to piezoelectric drive crystals on the droplet generator 34 at a level such that the vibration of the droplet generator shakes any remaining particles free from the orifice plate. The "super-stim" is first applied during a weeping crossflush, and then during an air ingest crossflush. The super-stim states are followed by another weeping crossflush of the drop generator, again with flush fluid, to remove any residue that may remain on the catcher 44 face or in the gap between the orifice plate and the charge plate.

The crossflush valve 32 is closed and the cleaning fluid pump 48 is servo-controlled to raise the flush fluid pressure in the drop generator to the necessary pressure, for example, 3 psi, forming jets of the flush fluid out of the orifices. As the ink pressure is rising to the desired pressure, for example, 3 psi, the rapid flow of ink out of the orifices pulls any fluid out of the gap between the orifice plate and the charge plate.

At this point in the startup sequence, the present invention diverges from known prior art. In the prior art, the ink pump would be turned on to match the pressure of the flush fluid in the drop generator. The flush fluid could then be stopped by closing the cleaner fluid valve 30 and turning off the cleaner fluid pump 24. While this transition from one fluid to the other was quite clean, a few spatters of ink could be deposited onto the charge plate. Heating the ink produced enough solvent vapors to cause solvent to condense onto the charge plate. The condensation was sufficient to rinse off the few ink splatter spots.

In accordance with the present invention, the transition from the flush fluid to the ink has been changed, such that the transition no longer results in ink being splattered onto the charge plate during the transition. By eliminating the ink spatters, it is no longer necessary to insert the condensation cleaning step to rinse away the splatter.

To eliminate the splatter during the transition from flush fluid to ink, the following steps are employed by the present invention, subsequent to the steps outlined above which establish the jetting of the flush fluid from the orifices of the drop generator. The flush fluid pressure is raised to 5 psi and the stimulation voltage is applied to the piezoelectric actuators of the drop generator. The 5 psi pressure is chosen to minimize the flow rate of the flush fluid to the drop generator while still maintaining sufficient pressure to ensure stable drop formation. After about 5 seconds, which is sufficient to ensure stable drop formation, charge voltage can be applied to the charging electrodes of the charge plate. In a preferred embodiment, 110 volts is used. This deflects the jetting drops toward the catcher. Even when stable drop formation has not occurred, such as at lower pressures, the jets of ink are still deflected away from the eyelid seal by the charge voltage applied at the charge leads. With the jetted fluid being deflected in this manner, ink pump 50 is turned on to pump ink from the ink tank 16, through the filter 52, and up to the printhead 28 via umbilical 54. The ink pump 50 is driven to match the output from the cleaner fluid pump 48. This can be done by energizing both pumps to equal voltages. If the same servo loop is used for both pumps, then the flow path of each fluid must be properly restricted to balance both the flow and the pressure supplied by the two pumps evenly at the printhead. At this ink pressure, the ink supply valve 64 is now opened, the cleaner fluid valve 30 closed, and the cleaner fluid pump is turned off. Alternatively, separate servo-control systems can be used for the two pumps to match the output pressure from each. Ink now replaces the flush fluid as the fluid being jetted from the orifices of the drop generator. This transition from flush fluid to ink, while fluid is being jetted, occurs with minimal disturbance to the jets. With ink now jetting from the orifices, the waste valve 36 is closed and the diverter valve 38 opened to direct ink from the catcher 44 back to the ink tank 16.

The present invention allows an operator to go from a down state to a printing state automatically, without requiring ink to be heated. A key feature of the present invention is the ability to control the jets of ink or make-up fluid by using voltage that is applied to the charge leads. The voltage deflects the jets of fluid toward the throat of the catcher where the fluid is taken back to the fluid system. Concurrent with deflecting the jetted fluid toward the catcher, the fluid is shifted from clear fluid to ink. During the transition, the jets are stimulated and at least partially deflected to the catcher to prevent splashing of the ink on the eyelid, and to prevent ink from wicking up the eyelid. The ability to control the jets of fluid with voltage during the start-up prevents splattering of fluid on the charge leads during the transition from make-up fluid to ink.

Having described the invention in detail and by reference to the preferred embodiment thereof, it will be apparent that other modifications and variations are possible without departing from the scope of the invention defined in the appended claims.

What is claimed is:

1. A method for starting a continuous inkjet printer having a printhead with an associated droplet generator, catcher and charge plate, having purge fluid jets for cleaning and ink for printing, the method comprising the steps of:

applying voltage to charge leads associated with the charge plate;

controlling the purge fluid jets and the ink by using the voltage applied to the charge leads;

deflecting the purge fluid jets and the ink, stimulated and unstimulated, toward a throat of the catcher where the fluid is taken back to a fluid system; and transitioning from use of purge fluid jets to ink while applying the voltage and deflecting toward the catcher.

2. A method as claimed in claim 1 wherein the step of applying voltage to charge leads further comprises the step of stimulating the jets to induce stable drop formation.

3. A method as claimed in claim 1 further comprising the step of providing a flush fluid to readily dissolve ink residues.

4. A method as claimed in claim 3 wherein the step of providing a flush fluid further comprises the step of directing the flush fluid to a waste tank after the flush fluid passes through the printhead so that concentration of the ink is not affected.

5. A method as claimed in claim 3 wherein the step of providing a flush fluid further comprises the step of using the flush fluid as a replenishment fluid to replenish ink lost to evaporation.

6. A method as claimed in claim 1 further comprising the step of providing at least one piezoelectric actuator driven at a high amplitude to generate vibration to loosen debris residues.

7. A method as claimed in claim 1 further comprising the step of supplying air to the printhead to displace flammable vapors from the printhead.

8. A method for starting a continuous inkjet printer having a printhead with an associated droplet generator and catcher and an orifice plate for jetting ink for printing, the method comprising the steps of:

providing a colorless flush fluid which readily dissolves the solvent ink;

crossflushing the colorless flush fluid through the droplet generator;

causing the colorless flush fluid to weep out of orifices in the orifice plate of the droplet generator to dissolve and rinse away ink residues from a charge plate associated with the droplet generator and from an exterior of the orifice plate;

applying charging voltage to charge electrodes associated with the charge plate to deflect jetted flush fluid toward the catcher; and changing the jetted flush fluid to ink without stopping jetting of fluid from the droplet generator orifices as the jetted fluid is being deflected toward the catcher.

9. The method as claimed in 8 wherein the ink for printing comprises a non aqueous ink or a volatile solvent based ink.

10. The method as claimed in claim 8 wherein the step of applying charging voltage further comprises the step of stimulating the jets to induce stable drop formation.

11. A method as claimed in claim 8 further comprising the step of directing the flush fluid to a waste tank after the flush fluid passes through the printhead so that concentration of the ink is not affected.

12. A method as claimed in claim 8 further comprising the step of using flush fluid as an ink replenishment fluid to replenish ink lost to evaporation.

13. A method as claimed in claim 8 further comprising the step of providing at least one piezoelectric actuator driven at high amplitude to vibrate loose debris.

14. A method as claimed in claim 8 further comprising the step of supplying air to the printhead to displace flammable vapors from the printhead.

15. A method as claimed in claim 14 wherein the step of pumping ink to the printhead further comprises the step of separating servo-control for the flush fluid from servo-control for ink pumping.

16. A method as claimed in claim 14 wherein the step of pumping ink to the printhead further comprises the step of driving the flush fluid and ink pumping at a same energizing potential.

17. A method as claimed in claim 8 wherein the step of changing the jetted fluid to ink further comprises the step of pumping ink to the printhead at a pressure matching a pressure of the jetting flush fluid.

18. A method as claimed in claim 8 wherein the step of changing the jetted fluid to ink further comprises the steps of:

providing first valve means which open to introduce ink into the droplet generator; and providing second valve means to stop flow of flush fluid to the droplet generator.

19. An automatic startup system for starting up a continuous inkjet printer having a printhead with an associated droplet generator and catcher and an orifice plate for jetting ink for printing, comprising:

a colorless flush fluid which readily dissolves the solvent ink;

means for crossflushing the colorless flush fluid through the droplet generator;

means for causing the colorless flush fluid to weep out of orifices in the orifice plate of the droplet generator to dissolve and rinse away ink residues from a charge plate associated with the droplet generator and from an exterior of the orifice plate;

a charging voltage applied to charge electrodes associated with the charge plate to deflect jetted flush fluid toward the catcher; and means for changing the jetted flush fluid to ink without stopping jetting of fluid from the droplet generator orifices as the jetted fluid is being deflected toward the catcher.

20. The system as claimed in claim 19 wherein the charging voltage further comprises means for stimulating the jets to induce stable drop formation.

21. A system as claimed in claim 19 wherein the means for changing the jetted fluid to ink further comprises means for pumping ink to the printhead at a pressure matching a pressure of the jetting flush fluid.

22. A system as claimed in 19 wherein the ink for printing comprises a non aqueous ink or a volatile solvent based ink.

* * * * *